United States Patent [19]

Dueringer

[11] Patent Number: 4,644,767

[45] Date of Patent: Feb. 24, 1987

[54] PERMUTATION LOCK HAVING ROTARY DIALS AND A DIAL LOCKING SPRING

[75] Inventor: Rudi Dueringer, Wuppertal, Fed. Rep. of Germany

[73] Assignee: S.Franzen Sohne GmbH & Co., Solingen, Fed. Rep. of Germany

[21] Appl. No.: 751,489

[22] Filed: Jul. 3, 1985

[30] Foreign Application Priority Data

Aug. 29, 1984 [DE] Fed. Rep. of Germany ..... 3431648

[51] Int. Cl.[4] ..... E05B 37/02; E05B 15/14

[52] U.S. Cl. ..... 70/312; 70/327

[58] Field of Search ..... 70/312, 327, 328, 67, 70/69–76, 68, 323

[56] References Cited

U.S. PATENT DOCUMENTS 3,555,860 1/1971 Atkinson ..... 70/312
4,279,136 7/1981 Milles ..... 70/71
4,354,366 10/1982 Bako ..... 70/312
4,366,684 1/1983 Bako ..... 70/312
4,366,686 1/1983 Remington ..... 70/312

FOREIGN PATENT DOCUMENTS 2940166 10/1980 Fed. Rep. of Germany .

*Primary Examiner*—Robert L. Wolfe
*Attorney, Agent, or Firm*—Burns, Doane, Swecker & Mathis

[57] ABSTRACT

A permutation lock includes a housing in which are disposed a plurality of rotary dials and a dial locking spring. The spring includes a base strip and a plurality of spring arms projecting therefrom, there being one spring arm per dial. The base strip is secured in place by means of the forces applied to the spring arms by the dials. Those forces urge the base plate firmly against a floor of the groove by swinging the locking spring about a fulcrum.

3 Claims, 4 Drawing Figures

PERMUTATION LOCK HAVING ROTARY DIALS AND A DIAL LOCKING SPRING

RELATED INVENTION

The disclosure of copending application Ser. No. 751,490, filed June 3, 1985 which relates to a similar lock, is hereby incorporated by reference herein.

BACKGROUND AND OBJECTS OF THE INVENTION

The invention concerns a permutation lock in which a plurality of rotary dials are retained in selected positions by means of a dial spring.

A permutation lock of this type is known from German DE-P No. 29 40 166. There, the dial spring includes arms extending from an integral base plate which corresponds in width to the width of the bottom of the housing. The arrangement is such that always a pair of arms are engaging each dial and act as locking springs. The base plate is relatively material intensive; a double quantity of the material is used per permutation lock. The dual arm locking engagement imparts more resistance, so that the zero-setting that may be overcome in one direction but not in the other direction (or perhaps only with extra effort), is no longer clearly distinct in "feel" from the other locking positions. The base plate is situated between the lock housing and an insert comprising the internal apparatus (dials, slide, etc.) and the front plate. A plurality of inwardly bent stop tabs project from angled edges of the base plate and abut against the projections of the insert to retain the base plate.

It is an object of the present invention to provide a permutation lock which is formed of less material and which maintains the distinctive "feel" when the dials have been rotated to a zero-setting.

SUMMARY OF THE INVENTION

The present invention relates to a permutation lock comprising a housing having front and rear sides. A groove is provided at the rear side and opens in the rearward direction. The groove extends in a longitudinal direction and includes a longitudinal floor and longitudinal shoulders. An axle is mounted in the housing and extends in the longitudinal direction. A plurality of dials are rotatably mounted on the axle. Each dial includes a plurality of setting marks spaced around the circumference and visible at the front side of the housing, and a plurality of locking marks spaced around the circumference in alternating relationship with the setting marks. A locking member is movable to an unlocking position when the dials are arranged in a predetermined pattern. A dial locking spring is disposed at a rear side of the housing for yieldably retaining the dials in their respective retaining positions. The dial locking spring is formed of a spring material and includes a base strip disposed in the groove and extending at an angle relative to the floor of the groove. The base strip includes a longitudinal edge engaging the shoulders of the groove. The spring also includes a plurality of spring arms extending from the edge so as to extend generally transversely relative to the longitudinal direction. The arms form an angle with the plane of the base strip and include free ends which form projections received in the locking notches to yieldably retain the dials in position. The arms engage portions of the housing at locations spaced from the projections and are biased rearwardly by the dials causing the base strip to be swung about the fulcrum to urge the base strip against the floor of the groove.

The configuration according to the invention provides a dial locking device that is readily assembled. The base plate is in the form of a narrow strip extending transversely to the arms. The assembly is secured in a groove of the housing open toward the bottom side. Securement of the spring body is effected simply by the angling of the base strip. As a result, the spring body is secured by utilizing the elastic resetting force of the spring arms, which resetting force acts toward the rear of the lock. Any tendency for the base strip to be displaced transversely to the longitudinal direction is resisted by the shoulders of the groove. In this manner, the assembled state of the spring body is accurately defined. Preferably, the shoulders are located between the arms. The groove and the internal space of the housing thus appear as spaces partially penetrating or intersecting each other. This is particularly advantageous in view of the injection molding process. In order to produce in a simple manner a left/right housing with the use of the same locking spring, the housing comprises on two opposing longitudinal edges a groove for the winding of the locking spring base plate. A much larger base plate with pairs of arms may thereby be eliminated. The base plate now requires only one-half of the material. Locking is less hard and is more distinct with respect to the so-called zero locking position and the remaining locking notches, which, however, may be overcome in both directions.

BRIEF DESCRIPTION OF THE DRAWINGS

The object of the invention will be explained in more detail by means of a preferred embodiment with reference to the drawing. In the drawing.

DETAILED DESCRIPTION OF A PREFERRED EMBODIMENT OF THE INVENTION

Figure 1:
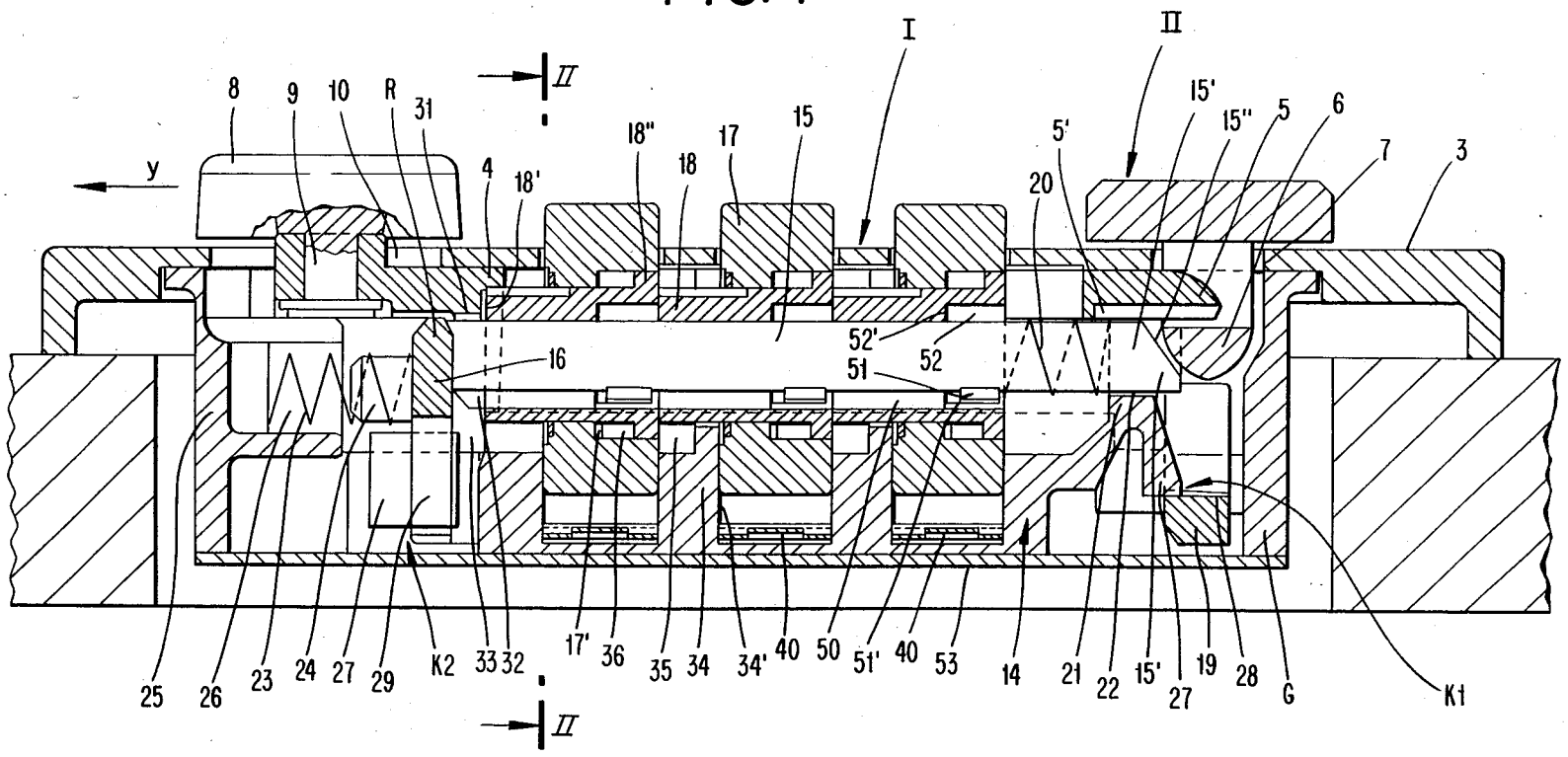
FIG. 1 is a longitudinal sectional view through a permutation lock according to the present invention.

A permutation lock according to the present invention comprises a permutation lock part I and a locking hasp part forming a counter lock part II.

The permutation lock part I is closed-off at the front by a plate 3. Behind the plate 3 an actuating slide 4 is located which is longitudinally displaceable against the action of a spring 23 as will be hereafter explained. A suitable stop limits the extent of longitudinal movement. The actuating slide 4 carries on its end facing the hasp, a locking projection 5 which engages a lug 6 of the hasp in a locking manner. The front plate 3 has an opening 7 for the passage of the lug 6.

In a terminal end of the actuating slide 4 remote from the hasp, a forwardly extending actuating handle 8 leading to the outside is located. The handle 8 includes a shaft 9 which projects through a window 10 of the front plate 3.

Figure 2:
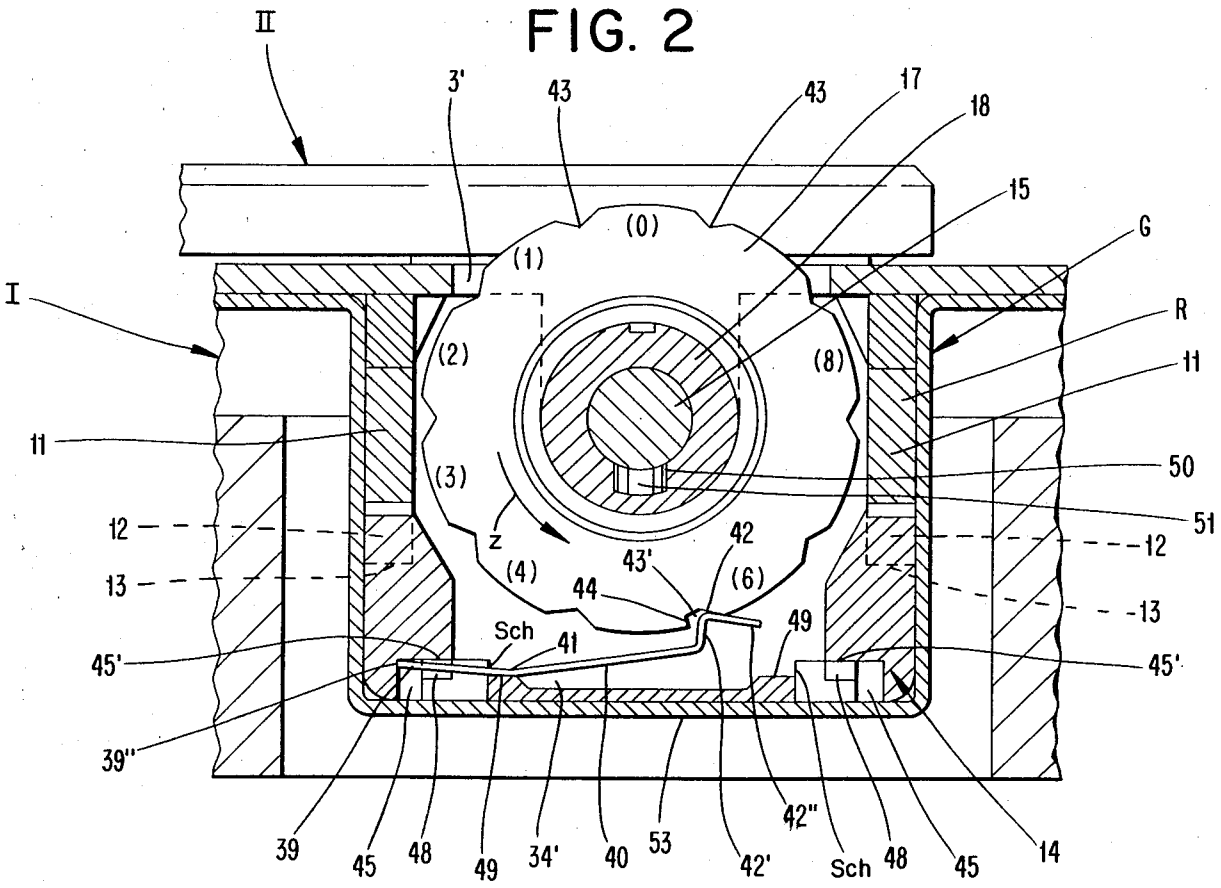
FIG. 2 is a cross-section taken along line II—II in FIG. 1.
Figure 3:
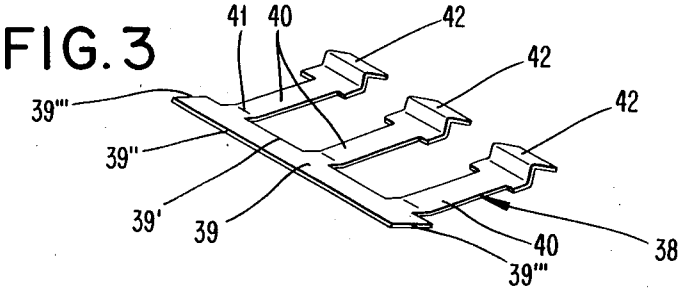
FIG. 3 depicts the dial locking spring in a perspective view.

The actuating slide 4 is displaceable in a plane disposed parallel to the front plate and is arranged to engage a frame R which is also displaceable longitudinally and which is limited by a suitable stop. The frame R, which is best shown in FIG. 8, includes rearwardly extending projections 12. The projections 12 are guided on lateral shoulders 13 of an insert part 14 of the lock housing (FIGS. 2 and 3). The projections 12 have a relatively small surface area and are located at corner regions of the frame R.

An axle 15 is molded integrally with the frame R and of the same material. The axle 15 commences at the transverse leg 16 adjacent the actuating handle and supports a plurality of locking sleeves 18 carrying the dials 17 arranged in a row.

To facilitate the threading of these parts, the axle 15 is free of the frame at its end 15' located opposite the transverse leg 16. That is, the axle is affixed to the frame R at only one end and extends in a cantilever fashion from such end. The axle 15 extends as far as the transverse leg 19, but terminates at a radial distance x from the leg 19 (FIG. 8). This spacing x between the free-floating end 15' of the axle 15 and the transverse leg 19 of the frame R occurs along the entire extent of the leg 19 due to an arc-like configuration of the leg 19, the concave side of the arc arranged to face the shaft. The distance x from the line of the arc (i.e., the inner or concave surface of the transverse leg 19 facing the axle 15) to the free end 15' corresponds at least to the radius of the dials 17. The insertion onto the axle of the locking sleeves 18 carrying the dials 17 is facilitated by a beveled frontal surface 15'' of the axle, as in this manner a taper (similar to that on a cannula) is obtained. The beveling further defines a portion of an entry space for the lug 16 of the counter lock part II (FIG. 1), thereby producing a very compact overall configuration. The annular dials 17 protrude partially through the orifices 3' of the front plate 3 so as to be manipulable from the outside.

A compression spring 20 is placed on the hasp side 15' of the axle 15. The spring 20 has an outwardly directed terminal spring coil which rests against a transverse wall 21 of the insert 14 of the locking housing, while the opposite terminal spring coil biases the locking sleeves 18 in a direction effecting a coupling engagement with the dials 17. The transverse wall 21 includes a depression 22 which opens toward the front plate and in which the "free-floating end 15" of the axle 15 is resting (FIGS. 1 and 5). In order to obtain adequate free space for the compression spring 20, the rear side of the locking projection 5 has a recess 5' which forms a part of the spring chamber.

A compression spring 23 biases frame R toward locking engagement with the lug 6 of the hasp. This compression spring 23 is seated on a peg 24 which extends from an outer surface of the transverse leg 16. The peg 24 is molded onto the leg 16 and has an axis which is slightly offset from the axis of the axle 15 in a rearward direction. The compression spring 23 is also supported on a side of the housing, specifically against a transverse wall 25 of the insert part 14 of the lock housing. The wall 25 forms a forwardly (radially) open spring insertion chamber 26 which also forms a space into which the pin 24 enters during displacement of the frame to the left.

This configuration and the depression 22 which opens forwardly toward the front plate 3, makes it possible to insert the preassembled locking unit of the frame R, dials 17, sleeves 18, springs 20, 23 rearwardly (transversely) into the insert 14 of the lock housing. In so doing, the dials 17 enter slots formed between spaced walls 34' of the insert part 14. The acutating slide 4 is subsequently mounted.

To secure the countersunk coordinated position of the locking unit and its secret code resetting device, the unit is clamped to the insert part 14 at clamping locations K1, K2 in the area of the transverse legs 16 and 19.

Figure 4:
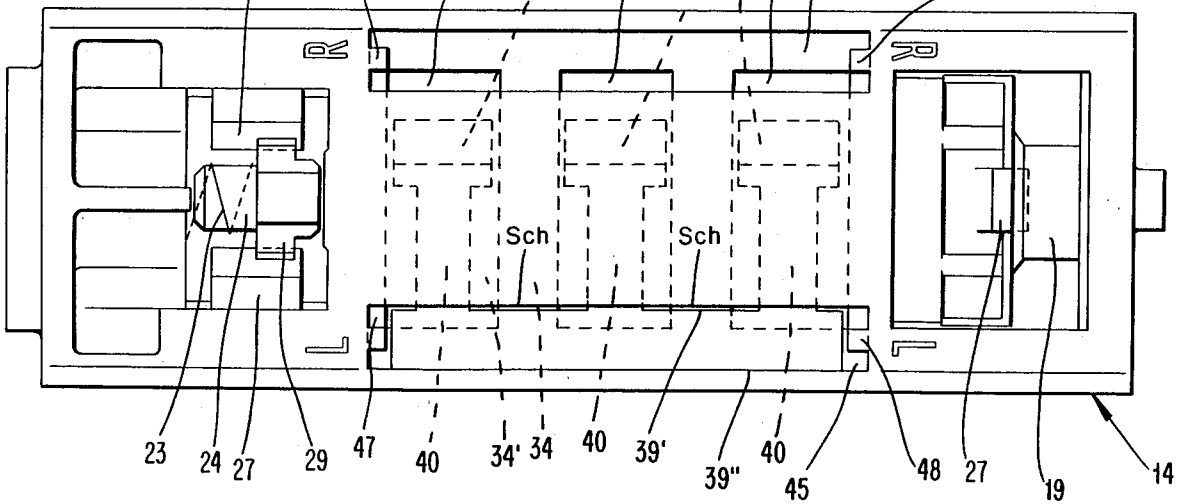
FIG. 4 is a rear view of a portion of the permutation lock with the protective shell of the housing omitted.

At the clamping location K1, a rearwardly projecting tongue 27 (clamping projection) of the insert part 14 presses against the arc-shaped transverse leg 19. The tongue 27 is received in a flattened longitudinal groove 28 of the leg 19 (FIG. 4). To facilitate the insertion of the leg 19 rearwardly past the tongue 27, an end surface 27A of the tongue is chamfered and a rear side of the wall 19 is correspondingly beveled at 19A. Thus, the wall 19 cams (flexes) the tongue (to the left as viewed in FIG. 1) as the frame R is inserted into the insert 14. The width of the transverse leg at the groove 28 is made long enough to accommodate the opening-actuating stroke of the locking slide 4 plus the frame R so that the tongue 27 stays in contact with the leg 19.

At the clamping location K2, a T-shaped rearwardly directed foot 29 of the frame R extends from the leg 16. A plane bisecting that foot 29 also includes the axle 15. The foot 29 includes ears 29' which are arranged to be engaged by tongues 27' formed as part of the insert part 14 of the lock housing. The tongues 27' converge toward the rear of the housing, so that bevels 27'A are present on the tongues 27' that are engaged by bevels 29'A on the ears to flex the tongues 27' as the frame R is inserted into the insert 14. The symmetrically located clamping shoulders 30 of the ears 29' are of such a length that the tongues 27' remain in contact with the ears 29' even during longitudinal displacement of the frame R.

Conveniently, the frame comprises a die cast metal part and the insert comprises an injection molded synthetic plastic part.

When displacing the actuating slide 4 in a direction Y for retracting the locking projection 5 (which is possible only with a correctly set secret code) the frame R is displaced against spring action (compression spring 23), by means of a fork 31 which extends rearwardly from a backside of the actuating slide 4 (FIGS. 1, 5). Prongs 32 of the fork 31 straddle the axle 15. For the entry of the fork 31 a receiving space 33 is provided between an inner side of the transverse leg 16 and a frontal end 18' of the outermost locking sleeve 18. Thus, actuation of the slide in the direction Y also displaces the frame R in that direction. The window 10 comprises in this direction, a free space z' corresponding to the stroke length.

Alteration of the secret code is possible, but only when the dials are set on the existing code. Alteration is effected by the extraction of the locking sleeves 18 from the dials 17 when the manual handle 8 is pushed in a direction opposite the direction Y. In the process, the frame R remains stationary, while the locking sleeves 18 are displaced to the necessary extent. The slots 34' of the insert 14 which receive the dials 17 include escape spaces 35 required for the extraction of the locking sleeves 18, with the collars 18'' of the locking sleeves entering such spaces 35, together with the coupling projections 36 provided on the collar side. In most cases, four such coupling projections are provided and they cooperate with a total of ten recesses 37 of the dial arranged at equal angles. In order for the locking sleeves 18 to be pushed back to the left by the spring 20, the coupling projections 36 and recesses 37 must be mutually aligned. Also, in the absence of such alignment, the locking projection 5 cannot be guided back through the lug 6 because the locking sleeve 18 protruding on the hasp side blocks the projection 5 from movement.

The prevailing angular positions of the dials 17, together with the locking sleeves 18, are retained by a dial locking spring 38. The dial spring 38 comprises a stamping which forms an elongated ledge or strip 39, from which a plurality of elastic spring arms 40 emanate in transverse succession and are spaced apart in accordance with the spacing of the dials. The strip 39 and the arms 40 are mutually bent toward each other at obtuse angles less than 180°. The apex 41 of the angle is not aligned with the narrow edge 39' of the strip, but is located at a slight distance from it.

The free ends of the arms 40 are double-angled to form cam-like locking projections 42. The projections comprise mutually angled segments 42', 42''. The segment 42' is angled approximately at right angles relative to the adjacent portion of the leg and extends toward the respective dial. The slightly longer segment 42'' forms an angle with the leg segment 42', which angle is less than 90°, but preferably about 80°. The width of each locking projection 42 (i.e., the dimension oriented parallel to the dial axis) is larger than that of the adjacent portion of the arm 40 and corresponds approximately to the width of the dials.

The projections 42 of the locking spring 38 engage locking notches 43 on the circumference of the dials 17. The notches 43 are uniformly distributed around the circumference of the dials 17. The notches are V-shaped to form angles of approximately 120° C. A locking notch 43' differs from this profile. The locking notch 43', which defines the so-called zero hold, includes a steep flank 44. That flank 44 extends in the radial direction of the dial. In the course of the rotation of the dial in the direction of arrow z (FIG. 2), the flank 44 imposes a stopping effect upon its impact with the flank 42' of the locking projection 42, which may be overcome with a conscious effort, using larger rotating forces. In this stop position, the zero field is centered in the respective orifice 3' in the front plate. The user thus recognizes by "feel", without a visual inspection, the initial position from which it is merely necessary to count the subsequent locking steps in order to set the secret code desired. The numerals shown in FIG. 2 are displayed on the wide surface of the dial for better comprehension only. They are, in practice, located on the circumferential fields which are clearly delineated visually by the locking notches 43, 43'.

In practice, the steeper flank 44 will pull against the arm 40 when the associated dial is rotated in the direction Z, but will not be able to pull the locking spring 38 out of its anchored position at the rear of the insert 14. The strip 39 is inserted into a fitting groove 45 open toward the rear side of the insert 14 by angling. The width of the groove corresponds to the width of the strip 39. As seen in FIG. 4, each groove 45 and the associated slot 34' of the locking housing insert 14 accepting the arm 40 in the vicinity of the rear, are connected with each other by means of a slit-like opening 47. These openings 47 are sized in accordance with the locking projections 42 and the thickness of their material, so that the locking projections may be inserted through the openings 47.

On the other hand, the areas remaining between the openings 47 are closed by the transverse walls 34 separating the dial slots 34' from each other, which walls are strapped at their rear ends to form a shoulder Sch on each wall.

One narrow edge 39' of the strip 39 (FIG. 4) is resting against this shoulder Sch thereby securing its position. The opposing narrow edge 39'' abuts against a vertical wall of the groove at a floor 45' of the groove 45.

Displacement in the longitudinal direction is also excluded because the ends of the strip 39 rest against or almost against molded-on projections 48 at the ends of the groove 45. Also, the projections 42 will bear against the walls 34 to resist longitudinal movement of the spring 38.

When the lock has been assembled, the spring arms 40 are permanently flexed rearwardly to press the strip 39 forwardly against the floor 45' of the groove 45. That is, the apexes of the arms 40 rest upon ledges 49 defined by the housing 14, which ledges 49 define fulcrums for the arms 40. The ledges 49 are spaced rearwardly from the plane of the floor 45' of the groove 45 to define a transitional step for the strip 39. If desired, the angle between the strip 39 and the arms 40 may be made large enough so that there occurs a prestressing of the spring 38 when the ledge has been inserted into the groove 45. That is, the angle between the strip 39 and the arms 40 may be made 15° to 20° larger than the resulting angle which occurs after assembly. That is, the spring is pre-stressed by that 15° to 20° deflection.

To use the same spring selectively in right or left oriented permutation locks, the insert 14 of the lock housing is equipped with a groove 45 each on two opposing longitudinal edges of the housing. The lock housing G is converted by a simple mirror image rotation from a right to a left-handed lock or vice versa. Appropriate markings on the rear side of the lock housing insert 14 (R for right, L for left) facilitate the foolproof assembly or the hopper filling in automatic assemblies.

To open the lock, it is necessary to know the secret code. An authorized user must set the dials 17 so that locking engagement spaces 50 are aligned with locking projections 51 carried on the side of the axle. The projections 51 extend successively in rows. If the appropriate pattern is present, the frame R carrying the axle 15 may be displaced, together with the slide 4 by moving the actuating handle in the direction Y (FIG. 1). If, on the other hand, at least one of the locking sleeves 18 has been rotated by means of the dial, the opening movement is blocked. This blocking occurs because a frontal end 51' of the projection 51 facing away from the catch abuts against an annular shoulder 52' of the annular free space 52 open on the catch side.

The lock housing insert is seated in a sheet metal section 53 U-shaped in cross-section, with the metal section protectively surrounding the lateral walls and the rear of the insert 14 and the lateral sections of the frame R.

As a result of the present invention, formation of the locking spring requires only a minimal amount of material. Nevertheless, the locking spring is amply secured in the housing and requires only a single spring arm per dial. As a result, the distinctive "feel" of the dials when in the zero setting is not marked.

Although the present invention has been described in connection with a preferred embodiment thereof, it will be appreciated by those skilled in the art that modifications, additions, substitutions, and deletions not specifically described, may be made without departing from the spirit and scope of the invention as defined in the appended claims.

What is claimed is:

1. A permutation lock comprising:

a housing having front and rear sides, a groove provided at said rear side and opening in the rearward direction, said groove extending in a longitudinal direction and including a longitudinal floor and longitudinal shoulders, an axle mounted in said housing and extending in said longitudinal direction, a plurality of dials rotatably mounted on said axle, each dial including a plurality of setting marks spaced around the circumference and visible at said front side of said housing, and a plurality of locking marks spaced around the circumference in alternating relationship with said setting marks, locking means movable to an unlocking position when said dials are arranged in a predetermined pattern, and a dial locking spring disposed at a rear side of said housing for yieldably retaining said dials in their respective retaining positions, said dial locking spring being formed of a spring material and including a base strip disposed in said groove and extending at an angle relative to said floor of said groove, said base strip including a longitudinal edge engaging said shoulders of said groove, and a plurality of spring arms extending from said edge so as to extend generally transversely relative to the longitudinal direction, said arms forming an angle with the plane of said base strip and incuding free ends which form projections which are received in said locking notches to yieldably retain said dials in position, said arms engaging portions of said housing at locations spaced from said projections and being biased rearwardly by said dials causing said base strip to be swung about a fulcrum defined by said housing portions to urge said base strip against said floor of said groove.

2. A permutation lock according to claim 1, wherein said fulcrum-defining portions of said housing are spaced rearwardly of the plane of said floor.

3. A permutation lock according to claim 1, wherein said housing comprises a second groove, second shoulders, and second fulcrum-defining positions located at an opposite side of said housing from said first-named groove, shoulders, and fulcrum defining portions so that said dial-locking spring can be inserted at either side of said housing.

* * * * *